US009114635B1

(12) United States Patent
Carlson et al.

(10) Patent No.: US 9,114,635 B1
(45) Date of Patent: Aug. 25, 2015

(54) DUAL PRINT HEAD ARRANGEMENT

(75) Inventors: Gregory F. Carlson, Corvallis, OR (US); Steven Goss, Corvallis, OR (US); James D. Bledsoe, Corvallis, OR (US)

(73) Assignee: Marvell World Trade Ltd., St. Michael (BB)

( * ) Notice: Subject to any disclaimer, the term of this patent is extended or adjusted under 35 U.S.C. 154(b) by 910 days.

(21) Appl. No.: 12/018,752

(22) Filed: Jan. 23, 2008

Related U.S. Application Data

(60) Provisional application No. 60/886,208, filed on Jan. 23, 2007.

(51) Int. Cl.
*B41J 3/60* (2006.01)
*B41J 3/54* (2006.01)

(52) U.S. Cl.
CPC ... *B41J 3/54* (2013.01); *B41J 3/543* (2013.01)

(58) Field of Classification Search
CPC ..... B41J 3/54; B41J 3/60; B41J 3/543
USPC ..... 400/149, 124.08, 124.09, 188; 347/104
See application file for complete search history.

(56) References Cited

U.S. PATENT DOCUMENTS

| | | | | |
|---|---|---|---|---|
| 5,081,472 | A * | 1/1992 | Fisher | 347/33 |
| 5,670,995 | A * | 9/1997 | Kupcho et al. | 347/5 |
| 5,764,263 | A * | 6/1998 | Lin | 347/101 |
| 5,992,986 | A * | 11/1999 | Gyotoku et al. | 347/85 |
| 6,784,906 | B2 * | 8/2004 | Long et al. | 347/171 |
| 6,916,132 | B2 * | 7/2005 | Otsuka et al. | 400/621 |
| 6,984,014 | B2 * | 1/2006 | Baiges | 347/20 |
| 7,675,534 | B2 * | 3/2010 | Fowlkes | 347/215 |
| 2003/0016983 | A1 * | 1/2003 | Baldwin-Garcia | 400/149 |
| 2005/0007413 | A1 * | 1/2005 | Uchisako et al. | 347/40 |
| 2005/0099484 | A1 * | 5/2005 | Silverbrook | 347/104 |
| 2006/0219113 | A1 | 10/2006 | Mukasa | |
| 2006/0239740 | A1 * | 10/2006 | Nam et al. | 400/120.01 |

FOREIGN PATENT DOCUMENTS

| | | | | |
|---|---|---|---|---|
| EP | 0 787 596 | A | 6/1997 | |
| EP | 09474340 | * | 12/2000 | B41J 3/60 |
| EP | 1 190 865 | A | 3/2002 | |
| JP | 03-051149 | * | 3/1991 | B41J 3/54 |
| JP | 06-191060 | * | 12/1992 | B41J 2/21 |
| JP | 06-55747 | * | 3/1994 | B41J 2/30 |
| JP | 09-290539 | * | 11/1997 | B41J 3/54 |
| JP | 10-76713 | * | 3/1998 | B41J 3/60 |
| JP | 11-34403 | * | 2/1999 | B41J 3/54 |
| JP | 11 034403 | A | 2/1999 | |
| JP | 2001-146006 | * | 5/2001 | B41J 2/01 |
| JP | 2004-199095 | * | 7/2001 | B41J 2/365 |
| JP | 2001-328297 | * | 11/2001 | B41J 3/54 |
| JP | 2002-248812 | * | 9/2002 | B41J 3/54 |

* cited by examiner

*Primary Examiner* — Blake A Tankersley
*Assistant Examiner* — Marissa Ferguson Samreth

(57) ABSTRACT

A printing apparatus that includes at least two print heads. The printing apparatus includes a body defining a printing cavity therein, a first print path defined within the printing cavity and a second print path defined within the printing cavity that is substantially parallel to the first print path. A first print head is arranged adjacent the first print path and a second print head is arranged adjacent the second print path. A device is provided to move a printing surface from the first print path to the second print path.

8 Claims, 5 Drawing Sheets

DUAL PRINT HEAD ARRANGEMENT

CROSS REFERENCE TO RELATED APPLICATIONS

The present application claims priority to U.S. Patent Application No. 60/886,208, filed Jan. 23, 2007, entitled "Printer With Dual Print Heads," the entire disclosure of which is hereby incorporated by reference in its entirety.

TECHNICAL FIELD

Embodiments of the present invention relate to the field of printers, and more particularly, to printers having two or more print heads.

BACKGROUND

In order to print on both sides of a page (generally referred to as duplex printing), printers typically print on one side of the page and then flip the page over using mechanical page transport mechanisms to use the same print head or marking engine to print on the other side of the page. Thus, in order to perform duplex printing, complicated mechanical arrangements are required. Furthermore, the speed of printing may be slow due to the need to maneuver the page so that it passes past the print head a second time. One further limitation with regard to attempting to achieve satisfactory duplex printing involves the fact that most ink jet print heads only function reliably when the ink ejection nozzles are facing in a downward direction.

SUMMARY

In accordance with various embodiments of the present invention, an apparatus includes a body defining a printing cavity therein, a first print path defined within the printing cavity and a second print path defined within the printing cavity that is substantially parallel to the first print path. A first print head is arranged adjacent the first print path and a second print head is arranged adjacent the second print path. A device is provided to move a printing surface from the first print path to the second print path. In accordance with various embodiments, the apparatus is a part of a printing apparatus. In accordance with other embodiments, the apparatus is a printing apparatus itself.

In accordance with various embodiments, the device is a roller.

In accordance with other embodiments, the device is a guide.

In accordance with various embodiments, the first and second print heads are coupled to a common transport carriage such that they may be moved together relative to the printing paths.

In accordance with other embodiments, the first print head is coupled to a first transport carriage and the second print head is coupled to a second transport carriage. The first transport carriage is capable of moving independently relative to the second transport carriage such that they may be moved independently relative to the printing paths.

In accordance with other embodiments, the first and second print heads are fixed relative to the printing paths.

In accordance with various embodiments, the first and second print heads are oriented in the same direction toward the first print path.

In accordance with various embodiments, the first and second print heads are aligned substantially one above the other.

In accordance with various embodiments, there are multiple print heads arranged along the first print path.

In accordance with various embodiments, there are multiple print heads arranged along the second print path.

The present invention also provides a method that includes moving a printing surface past at least one first print head along a first print path and depositing a printing substance on a first side of the printing surface with the at least one first print head. The method further includes moving the printing surface past at least one second print head along a second print path that is substantially parallel to the first print path and depositing a printing substance on a second side of the printing surface with the at least one second print head.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION OF EMBODIMENTS OF THE INVENTION

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Various operations may be described as multiple discrete operations in turn, in a manner that may be helpful in understanding embodiments of the present invention; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments of the present invention.

For the purposes of the present invention, the phrase "A/B" means A or B. For the purposes of the present invention, the phrase "A and/or B" means "(A), (B), or (A and B)". For the purposes of the present invention, the phrase "at least one of A, B, and C" means "(A), (B), (C), (A and B), (A and C), (B and C), or (A, B and C)". For the purposes of the present invention, the phrase "(A)B" means "(B) or (AB)" that is, A is an optional element.

The description may use the phrases "in an embodiment," or "in embodiments," which may each refer to one or more of the same or different embodiments. Furthermore, the terms "comprising," "including," "having," and the like, as used with respect to embodiments of the present invention, are synonymous.

Embodiments of the present invention provide a printing arrangement that includes at least print head along a first print path and at least one print head along a second print head.

Figure 1A:
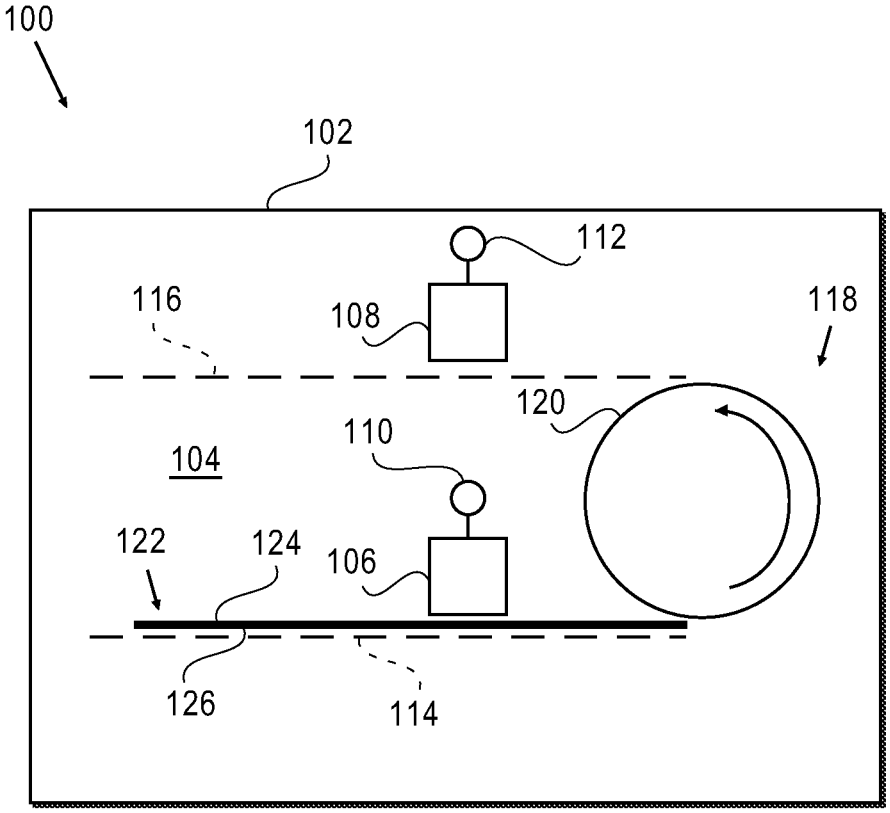
FIGS. 1A-1D schematically illustrate a printing arrangement that includes two print heads, in accordance with various embodiments of the present invention.
Figure 1B:
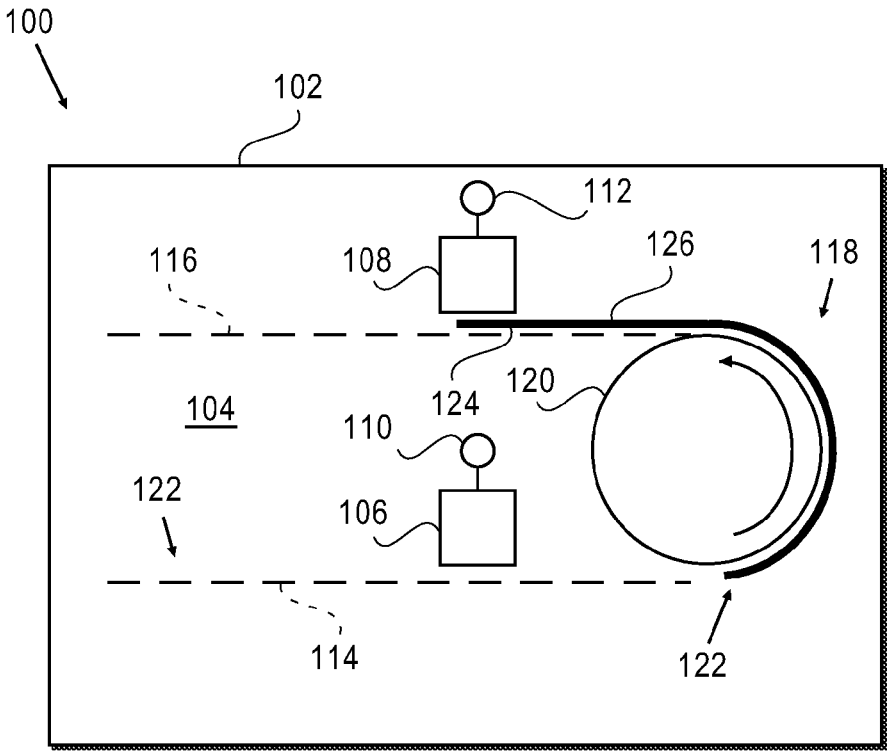
Figure 1C:
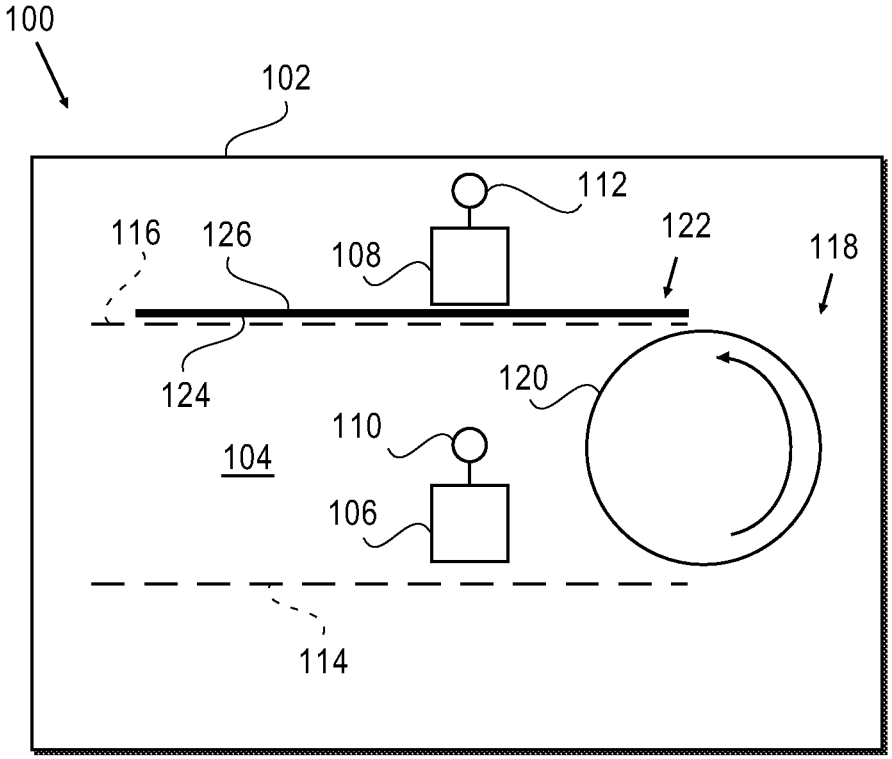

FIGS. 1A-1C schematically illustrates an apparatus 100 that includes a body 102 defining a printing cavity 104. The apparatus 100 may be a portion of a printing apparatus or may be a printing apparatus itself. Those skilled in the art will understand that more components generally would be included for apparatus 100. However, for clarity and simplicity, these other components are not illustrated in FIGS. 1A-1C.

The apparatus 100 further includes a first print head 106 and a second print head 108. The first print head 106 is generally supported by a first transport mechanism 110 while the second print head 108 is generally supported by a second transport mechanism 112. As may be seen, a first print path 114 is illustrated in dashed line adjacent to the first print head 106, while a second print path 116 is illustrated in dashed line adjacent to the second print head 108. A device 118 is provided at one end of the print paths 114, 116. In accordance with various embodiments of the present invention, the device 118 consists of a paper roller 120. In accordance with various embodiments, the print heads 106, 108 are facing in a downwardly direction such that they are facing their respective print paths 114, 116. Additionally, in accordance with various embodiments, the first print head 106 is arranged such that it is substantially aligned with the second print head 108 such that one print head is above the other.

In operation, as illustrated in FIG. 1A, a printing surface 122 such as, for example, a piece of paper, is fed through the printing cavity 104 along the first print path 114. As the printing surface 122 moves past the first print head 106, the first print head 106 deposits a printing substance, such as, for example, ink, onto a first side 124 of the printing surface 122. As illustrated in FIG. 1B, as the printing surface 122 moves further through the printing cavity 104, it will encounter the paper roller 120 around which the printing surface 122 will move thereby causing it to now move along the second print path 116 and past the second print head 108 along the second print path 116. As illustrated in FIG. 1C, as the printing surface 122 moves past the second print head 108, the second print head 108 deposits a printing substance such as, for example, ink, onto a second side 126 of the printing surface 122.

Figure 1D:
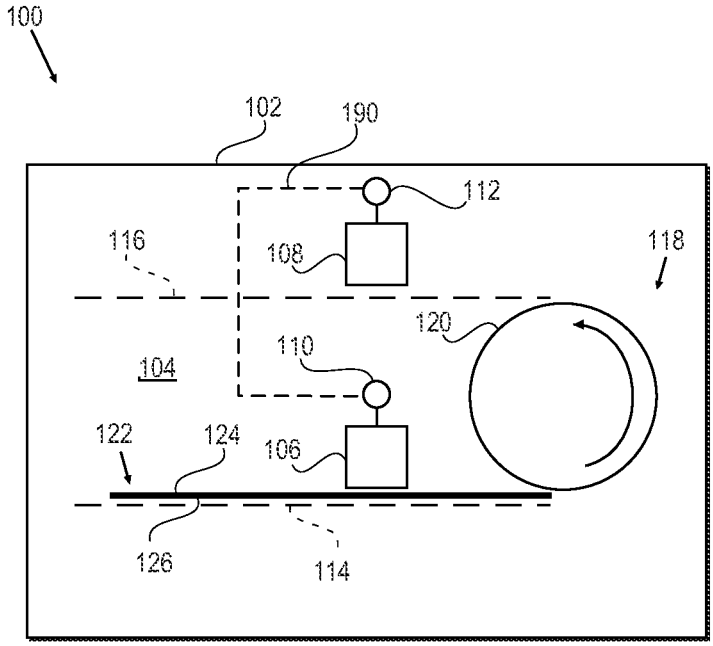

In accordance with various embodiments of the present invention, as the print heads 106, 108 are depositing a printing substance onto the printing surface, they may be moving back and forth relative to the printing surface 122. Thus, as known in the art, the transport carriages 110, 112 to which the print heads 106, 108 are coupled and by which they are supported may cause the print heads 106, 108 to move relative to the printing surface 122. In accordance with various embodiments, the first transport carriage 110 and the second transport carriage 112 are coupled to each other, or in fact are integrated such that they form one overall transport carriage, and therefore, the first and second print heads 106, 108 move together relative to the printing surface 122. For example, as illustrated in FIG. 1D, the first transport carriage 110 and the second transport carriage 112 are coupled to each other through a coupling 190. The first transport carriage 110, the second transport carriage 112 and the coupling 190 form, for example, one overall transport carriage. In accordance with other embodiments, the transport carriages 110, 112 are independent of each other and therefore, move independently of each other relative to the printing surface 122. In accordance with other embodiments of the present invention, the print heads 106, 108 do not move relative to the printing surface and therefore, they extend laterally across the width of their respective print paths 114, 116, or multiple print heads may extend laterally across print path 116 and/or print path 118. Thus, in such an embodiment, the print heads 106, 108 and the transport carriages 110, 112 are fixed relative to the print paths 114, 116. Control logic within a control module (not shown) of the apparatus 100 controls the print heads 106, 108 and/or the transport carriages 114, 116 such that the print heads 106, 108 deposit the appropriate printing substances onto the printing surface 122 at the appropriate time as the printing surface 122 moves along the first and second print paths 114, 116.

Figure 2:
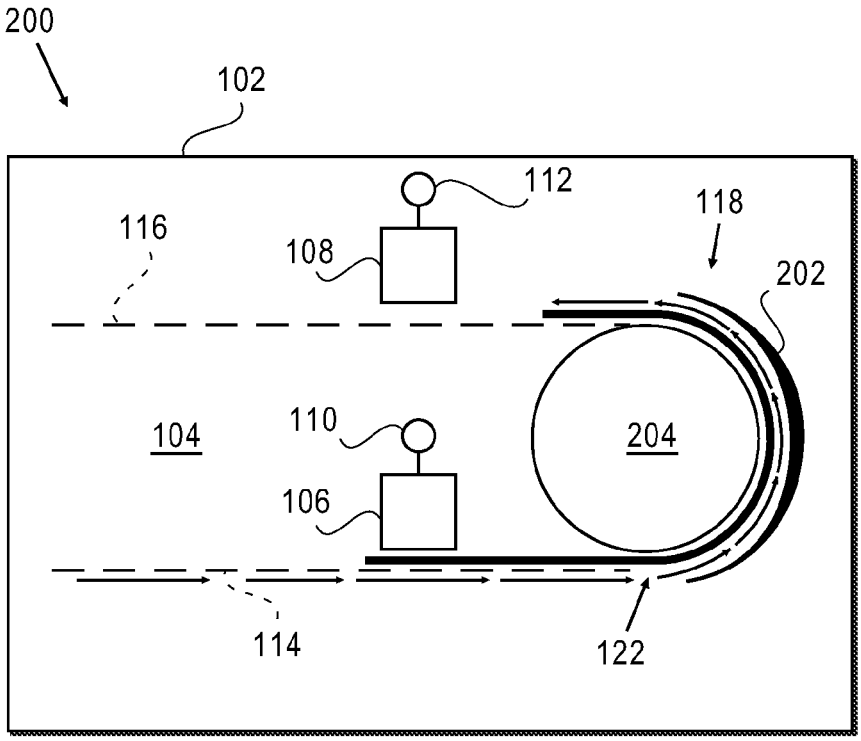
FIG. 2 illustrates another embodiment of the printing arrangement illustrated in FIGS. 1A-1D, in accordance with various embodiments of the present invention.

As illustrated in FIG. 2, in accordance with another embodiment, the device 118 comprises a curved guide 202 coupled to or defined within the body 102 of the apparatus 100 to thereby cause the printing surface to move from the first print path 114 to the second print path 116. A stationary roller cylinder 204 may be provided adjacent the guide 202 if desired. Thus, in such an embodiment, the printing surface 122 will move along the first print path 114 via appropriate means until the edge of the printing surface 122 encounters the curved guide 202. The printing surface 122 will then move along the curved guide 202 and begin to move along the second print path 116.

Those skilled in the art will understand that while only one print head 106, 108 is illustrated along each print path 114, 116, respectively, more than one print head may be included along either print path if desired.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments illustrated and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is intended that embodiments in accordance with the present invention be limited only by the claims and the equivalents thereof.

What is claimed is:

1. An apparatus comprising:

a body, wherein the body includes a printing cavity defined within the body;

a first print path defined within the printing cavity;

a second print path defined within the printing cavity and being substantially parallel to the first print path;

a first print head arranged adjacent the first print path;

a second print head arranged adjacent the second print path;

an arrangement to move a printing surface from the first print path to the second print path, wherein (i) the first print head is configured to deposit a printing substance onto a first side of the printing surface as the printing surface moves past the first print head along the first print path, and (ii) subsequent to the arrangement moving the printing surface from the first print path to the second print path, the second print head is configured to deposit the printing substance onto a second side of the printing surface as the printing surface moves past the first print head along the first print path, wherein the second side of the printing surface is opposite to the first side of the printing surface;

a first transport carriage coupled to the first print head; and a second transport carriage coupled to the second print head, wherein the first transport carriage and the second transport carriage are coupled to each other such that the first transport carriage and the second transport carriage are configured to move in unison relative to the printing surface as each of the first print head and the second print head respectively deposits the printing substance onto the first side and the second side of the printing surface.

2. The apparatus of claim 1, wherein the first transport carriage and the second transport carriage form an integrated transport carriage.

3. The apparatus of claim 1, wherein the first print head is aligned substantially below the second print head.

4. The apparatus of claim 1, wherein the first print head is oriented in a downward direction towards the first print path, and the second print head is oriented in the downward direction towards the second print path.

5. The apparatus of claim 1, wherein the arrangement comprises:

a curved guide defined within the body to guide the printing surface from the first print path to the second print path.

6. The apparatus of claim 5, wherein the arrangement further comprises:

a stationary cylinder adjacent to the curved guide to facilitate guiding the printing surface from the first print path to the second print path.

7. The apparatus of claim 1, wherein the arrangement comprises:

a roller to move the printing surface from the first print path to the second print path.

8. The apparatus of claim 1, wherein the arrangement is configured to:

move the printing surface in a first direction along the first print path; and move the printing surface in a second direction along the second print path, wherein the second direction is opposite to the first direction.

* * * * *